US010648740B2

(12) United States Patent
Bugler et al.

(10) Patent No.: US 10,648,740 B2
(45) Date of Patent: May 12, 2020

(54) MINI-TUBE AIR COOLED INDUSTRIAL STEAM CONDENSER

(71) Applicant: Evapco, Inc., Taneytown, MD (US)

(72) Inventors: Tom Bugler, Frederick, MD (US); Jean-Pierre Libert, Frederick, MD (US); Mark Huber, Sykesville, MD (US)

(73) Assignee: Evapco, Inc., Taneytown, MD (US)

( * ) Notice: Subject to any disclaimer, the term of this patent is extended or adjusted under 35 U.S.C. 154(b) by 14 days.

(21) Appl. No.: 16/009,594

(22) Filed: Jun. 15, 2018

(65) Prior Publication Data

US 2019/0137182 A1 May 9, 2019

Related U.S. Application Data

(63) Continuation of application No. 15/624,587, filed on Jun. 15, 2017, now Pat. No. 10,024,600.

(60) Provisional application No. 62/438,142, filed on Dec. 22, 2016, provisional application No. 62/353,030, filed on Jun. 21, 2016.

(51) Int. Cl.

| | |
|---|---|
| ***F28F 9/26*** | (2006.01) |
| ***F28B 1/06*** | (2006.01) |
| ***F28D 1/04*** | (2006.01) |
| ***F28B 7/00*** | (2006.01) |

(52) U.S. Cl.

CPC ..... *F28B 1/06* (2013.01); *F28B 7/00* (2013.01); *F28D 1/0426* (2013.01); *F25B 2339/04* (2013.01); *F28B 2001/065* (2013.01)

(58) Field of Classification Search

CPC . F28B 1/06; F28B 7/00; F28D 1/0426; B01D 5/012; F25D 17/02; F25B 2339/04; F25B 2001/065

USPC ..... 165/144

See application file for complete search history.

(56) References Cited

U.S. PATENT DOCUMENTS

| | | | | |
|---|---|---|---|---|
| 3,720,071 A * | 3/1973 | Nasser | B01D 5/0012 | 165/166 |
| 4,513,813 A * | 4/1985 | Zanobini | F28B 1/06 | 165/110 |
| 4,926,931 A * | 5/1990 | Larinoff | F28B 1/06 | 165/111 |
| 2013/0292103 A1* | 11/2013 | Eindhoven | F28B 1/06 | 165/173 |
| 2013/0312932 A1* | 11/2013 | Vouche | F28B 1/06 | 165/67 |

(Continued)

*Primary Examiner* — Davis D Hwu

(74) *Attorney, Agent, or Firm* — Whiteford, Taylor & Preston, LLP; Peter J. Davis

(57) ABSTRACT

Large scale field erected air cooled industrial steam condenser having 10 heat exchanger bundles per cell arranged in five pairs in a V-shape, each heat exchanger bundle having four primary heat exchangers and four secondary heat exchangers in which each secondary heat exchanger is paired with a single primary heat exchanger. Four primary condensers are arranged such that the tubes are horizontal, while the inlet steam manifolds at one end of the tubes are perpendicular to the primary condenser tubes, i.e., parallel to the transverse axis of the bundle. Steam enters the small inlet steam manifolds from below. Cross-sectional dimensions of the tubes are 200 mm wide with a cross-section height of less than 10 mm with fins that are 10 mm in height, arranged at 9 to 12 fins per inch.

6 Claims, 13 Drawing Sheets

(56) References Cited

U.S. PATENT DOCUMENTS

| | | | | |
|---|---|---|---|---|
| 2014/0367243 | A1* | 12/2014 | Kroger | F28B 1/06 202/161 |
| 2015/0027679 | A1* | 1/2015 | Singh | F28B 1/06 165/182 |
| 2015/0204611 | A1* | 7/2015 | Vouche | F28B 1/06 165/122 |
| 2015/0330709 | A1* | 11/2015 | Vouche | F28B 1/06 202/185.3 |
| 2016/0183408 | A1* | 6/2016 | Sutherland | F25D 17/02 62/93 |

* cited by examiner

MINI-TUBE AIR COOLED INDUSTRIAL STEAM CONDENSER

BACKGROUND OF THE INVENTION

Field of the Invention

The present invention relates to large scale field erected air cooled industrial steam condensers.

Description of the Background

The current finned tube used in most large scale field erected air cooled industrial steam condensers (ACC) uses a flattened tube that is approximately 11 meters long by 200 mm wide (also referred to as "air travel length") with semi-circular leading and trailing edges, and 18.7 mm external height (perpendicular to the air travel length). Tube wall thickness is 1.35 mm. Fins are brazed to both flat sides of each tube. The fins are usually 18.5 mm tall, spaced at 11 fins per inch. The fin surface has a wavy pattern to enhance heat transfer and help fin stiffness. The standard spacing between tubes, center to center, is 57.2 mm. The tubes themselves make up approximately one third of the cross sectional face area (perpendicular to the air flow direction); whereas the fins make up nearly two thirds of the cross section face area. There is a small space between adjacent fin tips of 1.5 mm. For summer ambient conditions, maximum steam velocity through the tubes can typically be as high as 28 mps, and more typically 23 to 25 mps. The combined single A-frame design along with these tubes and fins has been optimized based on the length of the tube, the fin spacing, fin height and shape, and the air travel length. The finned tubes are assembled into heat exchanger bundles, typically 39 tubes per heat exchanger bundles, and 10 to 14 bundles are arranged into two bundles arranged together in a single A-frame per fan. The fan is typically below the A-frame forcing air up through the bundles. The overall tube and fin design, and the air pressure drop of the tube and fin combination, has also been optimized to match the air moving capacity of the large (up to 38 ft diameter) fans operating at 200 to 250 hp. This optimized arrangement has remained relatively unchanged across many different manufacturers since the introduction of the single row elliptical tube concept over 20 years ago.

The typical A-Frame ACC described above includes both $1^{st}$ stage or "primary" condenser bundles and $2^{nd}$ stage or "secondary" bundles. About 80% to 90% of the heat exchanger bundles are $1^{st}$ stage or primary condenser. The steam enters the top of the primary condenser bundles and the condensate and some steam leaves the bottom. The first stage configuration is thermally efficient; however, it does not provide a means for removing non-condensable gases. To sweep the non-condensable gases through the $1^{st}$ stage bundles, 10% to 20% of the heat exchanger bundles are configured as $2^{nd}$ stage or secondary condensers, typically interspersed among the primary condensers, which draw vapor from the lower condensate manifold. In this arrangement, steam and non-condensable gases travel through the $1^{st}$ stage condensers as they are drawn into the bottom of the secondary condenser. As the mixture of gases travels up through the secondary condenser, the remainder of the steam condenses, concentrating the non-condensable gases. The tops of the secondary condensers are attached to a vacuum manifold which removes the non-condensable gases from the system.

Variations to the standard prior art ACC arrangement have been disclosed, for example in US 2015/0204611 and US 2015/0330709. These applications show the same finned tubes, but drastically shortened and then arranged in a series of small A-frames, typically five A-frames per fan. Part of the logic is to reduce the steam pressure drop, which has a small effect on overall capacity at summer condition, but greater effect at a winter condition. Another part of the logic is to weld the top steam manifold duct to each of the bundles at the factory and ship them together, thus saving expensive field welding labor. The net effect of this arrangement, with the steam manifold attached at the factory and shipped with the tube bundles, is a reduction of the tube length to accommodate the manifold in a standard high cube shipping container. Because the tubes are shorter, and therefore the overall amount of surface area is reduced, comparative capacity to the standard single A-frame design of similar overall dimension, summer condition, is reduced by about 3%.

SUMMARY OF THE INVENTION

The inventions presented herein are 1) a new tube design for use in heat exchanger systems, including but not limited to large scale field erected air cooled industrial steam condensers; and 2) a new design for large scale field erected air cooled industrial steam condensers for power plants and the like, both of which significantly increase the thermal capacity of the ACC while, in some configurations, reduce the material. Various aspects and/or embodiments of the inventions are set forth below:

According to a preferred embodiment of the tube design invention, the cross-sectional dimensions of the tubes are 200 mm wide (air travel length), like the prior art, but with a cross-section height (perpendicular to the air travel length) of less than 10 mm, preferably 4-10 mm, more preferably 5.0-9 mm, even more preferably 5.2-7 mm, and most preferably 6.0 mm in height (also "outside tube width"), with fins that are 8-12 mm in height, preferably 10 mm in height, arranged at 8-12 fins per inch, preferably 11 fins per inch. According to a further preferred embodiment, actual fins may be 16-22 mm in height, preferably 18.5 mm in height, and span the space between two adjacent tubes, effectively making 8-11 mm of fin available to each tube on each side.

The making of smaller cross-section tubes (same air travel length but significantly smaller height) is directly counter to the current prevailing view in the art that the tubes should be made with as large a cross-section as possible in order to accommodate the massive volumes of steam that is output by a large scale power plant, and because larger tubes drive down costs. While the costs of this arrangement is significantly more than the prior art tube arrangement, the inventors unexpectedly discovered that the increases in efficiency with the lower height tubes (in the most preferred embodiment exceeding 30% greater efficiency as compared to the prior art tubes) more than make up for the increase in cost. This new tube design may be used in large scale field erected air cooled industrial steam condensers of the prior art (for example as described in the background section), or it may be used in conjunction with the new ACC design described herein below.

Turning to the new design for large scale field erected air cooled industrial steam condensers, a primary feature of this invention, is that the multiple primary and secondary condensers are arranged in a new design that reduces steam manifold costs and also increases the thermal capacity significantly at the same time allowing for easy containerized shipment and minimal field welding.

According to one embodiment of this invention, the design features 10 heat exchanger bundles per cell arranged in five pairs as "V's" (a configuration that is inverted compared to standard prior art ACC arrangements). According to an alternative embodiment, the bundles may be arranged in an A-frame arrangement, but such embodiments require additional ductwork and therefore cost.

In the preferred arrangement, each heat exchanger bundle has four primary heat exchangers and four secondary heat exchangers in which each secondary heat exchanger is paired with a single primary heat exchanger. According to an alternative embodiment, only one secondary heat exchanger is provided per heat exchanger core; but, matching each secondary heat exchanger to a single primary heat exchanger has the advantage of minimizing condenser piping/heading. According to further alternative embodiments, three or even two or five or more heat exchangers may be provided per heat exchanger core, with subsequent trade-offs of capacity and cost.

According to a preferred embodiment, four primary condensers are arranged such that the tubes are horizontal, while the inlet steam manifolds at one end of the tubes are aligned parallel with the transverse axis of the bundle. This arrangement allows the steam to enter the small inlet steam manifolds from below. According to an alternative embodiment, the steam may be introduced from above, but this embodiment requires more ductwork.

According to a preferred embodiment, the vertical width of each bundle is 91 inches (2.3 m) to 101 inches (2.57 m).

The preferred bundle length is 41 ft to 43 ft, but various other shorter lengths may be provided, including 38 ft. According to one embodiment, two of the small secondary condensers may be attached to the primary condensers on site with very little additional field welding costs. This embodiment is particularly useful in the case that the desired core length is longer than a shipping container length.

According to a preferred embodiment, for bundles with four primary condensers, each horizontal bundle length has a tube length of 2.2 m to 2.8 m. For bundles with five primary condensers per bundle, each horizontal bundle length has a tube length of 1.75 m to 2.25 m, and preferably 2.0 m. The steam manifold and outlet manifold have a preferred width (perpendicular to the vertical length of the manifold) of 0.065 m to 0.10 m, preferably 0.075 m. Each primary condenser is preferably attached directly to a secondary condenser having finned tubes having longitudinal axes that are aligned parallel to the transverse axis of the bundle, configured to receive steam from the bottom and preferably sized to have a face area of 10% to 20% of the face area of its corresponding primary condenser, and in the case of a primary condenser having dimension of 2.3 m by 2.4 m, the secondary condenser is, by example, 0.20 m to 0.45 m wide, preferably 0.31 m wide.

According to a preferred embodiment, a heat exchanger bundle consists, from one end to the other of the following: a small secondary condenser (10-20% of the face area of the corresponding primary coil) having tubes that are aligned parallel to the transverse axis of the bundle, followed by a full size primary condenser with horizontal tubes (aligned parallel to the longitudinal axis of the bundle), with a condensate header between the primary condenser and the secondary condenser which is connected along its side to the outlets of the tubes of the primary condenser and connected at its bottom to the inlet of the secondary condenser for delivery remaining steam and non-condensable gases directly into the secondary condenser. The steam inlet manifold is at the far end of the first primary condenser. The second primary and second secondary condensers are mirrored from the first, completing the first half of the heat exchanger bundle. The second half of the heat exchanger mirrors the first half.

Bundles are then paired together, preferably in V-frames. This brings two sets of four steam inlets to two single small areas. These four inlets may be joined to a single steam riser emanating from a large steam duct below, and connected together via a one-to-four adapter. No welding of steam manifold across the length of the bundles is required. As discussed above, A-frames may be used, but are less cost effective because traditional A-frame ACC construction requires the steam ducts to be placed above the coils/bundles, rather than below.

Steam is delivered to the heat exchanger bundle via a steam duct. Risers deliver the steam from the steam duct to the heat exchanger inlets which in turn deliver the steam to the steam inlet manifolds. The steam inlet manifolds deliver the steam to the horizontally oriented tubes of the primary condenser. Much of the steam condenses to liquid water as it traverses the tubes of the primary condenser. The tubes of the primary condenser terminate at the condensate header which receives the condensate and the remaining steam (including non-condensable gases). The bottom of the condensate header has a "foot" portion which extends under and opens into the bottom of the secondary condenser. The condensate collects at the bottom of the condensate header, where it is delivered to a condensate collection tube. Meanwhile, the remaining steam, including non-condensable gases is drawn out of the condensate header upward through the secondary condenser. As the remaining steam condenses, the condensate travels back down through the secondary condenser, into the foot of the condensate header and into the condensate collection tube. The non-condensable gases exit the secondary condenser via a non-condensable collection tube.

As discussed, this new ACC design may be used with tubes having prior art cross-section configuration and area (200 mm×18.7 mm), in which case the increase in efficiency is approximately 5%. Alternatively, this new ACC design may be used with tubes having the new design described herein (200 mm× less than 10 mm), in which the increase in efficiency, compared to prior art A-Frame with standard tube configurations is approximately 22%.

According to a further alternative embodiment, the new ACC design of the present invention may be used with 100 mm by 5 mm to 7 mm tubes having offset fins. This embodiment produces a total increase in capacity of 17.5% as compared to standard ACC configuration with standard tubes, with a reduction in tube and fin costs of approximately 40% with a concurrent reduction of supported bundle weight. According to this embodiment, the bundles will also weigh about 60% of prior art bundles and therefore be more easily supported within the new ACC structure.

According to a further embodiment, the new ACC design of the present invention may be used with 200 mm by 5 mm to 7 mm tubes having "Arrowhead"-type fins arranged at 9.8 fins per inch). This embodiment produces a total increase in capacity of more than 30% as compared to standard ACC configuration with standard tubes.

According to a further embodiment, the new ACC design of the present invention may be used with 120 mm by 5 mm to 7 mm tubes having "Arrowhead"-type fins arranged at 9.8 fins per inch). This embodiment produces a total increase in capacity of more than 17% as compared to standard ACC configuration with standard tubes. According to an even further embodiment, the new ACC design of the present invention may be used with 140 mm by 5 mm to 7 mm tubes having "Arrowhead"-type fins arranged at 9.8 fins per inch). This embodiment produces a total increase in capacity of more than 23% as compared to standard ACC configuration with standard tubes. While the 120 mm and 140 mm configurations do not produce quite the same increase in capacity as the 200 mm configuration, both the 120 mm and 140 mm configurations have reduced materials and weight compared to the 200 mm design.

For a disclosure of the structure of Arrowhead-type fins discussed above, the disclosure of U.S. application Ser. No. 15/425,454, filed Feb. 6, 2017 is incorporated herein in its entirety.

According to yet another embodiment, the new ACC design of the present invention may be used with tubes having "louvered" fins, which perform approximately as well as offset fins, and are more readily available and easier to manufacture.

With the prior art, the heat exchanger fins and tubes are brazed together one tube at a time. According to the present invention, with these smaller bundles and smaller tubes, it is possible to braze multiple finned tubes as a single assembly, cutting manufacturing costs, eliminating an air gap between finned tubes that hurts performance and providing a strong structure between adjacent tube walls to prevent their collapse under vacuum. Moreover, significant surface area is gained for the fins and tubes with the arrangement of the present invention, especially since the total area for heat transfer is limited by the shipping container door size. Since the tube length or bundle width is not reduced by the steam manifold required with other designs, this arrangement provides for more effective heat exchange area per shipping container-sized unit than any other design.

In summary, the total gain in steam condensing capacity and cost reduction for the present invention compared to an equivalent size device of the prior art is as much as 33%, at constant fan power per fan. For a multiple cell ACC, the number of fans can be reduced because each cell has higher capacity and fewer cells are required to do the steam condensing duty, total fan power can be reduced by more than 25%.

Additionally, the ACC design of the present invention can be sited more easily, requiring less overall space within the power plant.

Accordingly, there is provided according to an embodiment of the invention, a large scale field erected air cooled industrial steam condenser connected to an industrial steam producing facility, having a plurality of pairs of heat exchanger bundles, each pair of heat exchanger bundles arranged in a V-shape configuration, and each heat exchanger bundle having a longitudinal axis and a transverse axis perpendicular to its longitudinal axis, each heat exchanger bundle comprising a plurality of steam inlet manifolds, a plurality of primary condenser sections, a plurality of outlet condensate headers, and at least one secondary condenser section; each primary condenser comprising a plurality finned tubes each having a longitudinal axis parallel to a corresponding heat exchanger bundle longitudinal axis; each secondary condenser comprising a plurality of finned tubes each having a longitudinal axis parallel to a corresponding heat exchanger transverse axis; each of said steam inlet manifolds having a longitudinal axis parallel to a corresponding heat exchanger transverse axis, each steam inlet manifold configured to receive steam from a steam distribution manifold located below said heat exchange bundles and to distribute steam to a first end of said plurality of finned tubes in a corresponding primary condenser; each of said outlet condensate headers having a longitudinal axis parallel to a corresponding heat exchanger transverse axis and connected on a first side to a second end of said plurality of finned tubes in a corresponding primary condenser to collect condensate, uncondensed steam, and non-condensable gases therefrom; each said outlet condensate header connected on a bottom end to a bottom end of said at least one secondary condenser section, each of said outlet condensate headers also connected at a bottom end to a condensate collection tube, and each said secondary condenser section connected at a top end to a non-condensable collection tube.

There is also provided according to an embodiment of the invention a large scale field erected air cooled industrial steam condenser comprising equal numbers of primary and secondary condensers, each second condenser paired with a single primary condenser.

There is also provided according to an embodiment of the invention a large scale field erected air cooled industrial steam condenser, wherein each heat exchanger bundle comprises four primary condensers and four secondary condensers, wherein the left-to-right orientation of each said primary condenser/secondary condenser pair is reversed relative to an adjacent primary condenser/secondary condenser pair, so that a first two of said steam inlet manifolds in a heat exchanger bundle are directly adjacent to one-another and a second two of said steam inlet manifolds in the same heat exchanger bundle are directly adjacent to one-another.

There is also provided according to an embodiment of the invention a large scale field erected air cooled industrial steam condenser, wherein bottom ends of said steam inlet manifolds of a first heat exchange bundle are adjacent to bottom ends of steam inlet manifolds in a second heat exchanger bundle in a pair of heat exchange bundles.

There is also provided according to an embodiment of the invention a large scale field erected air cooled industrial steam condenser wherein bottom ends of said two adjacent steam inlet manifolds from a first heat exchange bundle and bottom ends of two adjacent steam inlet manifolds from a second heat exchange bundle in a pair of heat exchange bundles are connected to a first end of a one-to-four steam manifold adapter, and wherein a second end of said one-to-four steam manifold adapter is connected to a steam supply manifold.

There is also provided according to an embodiment of the invention a large scale field erected air cooled industrial steam condenser wherein said plurality of finned tubes in said primary condensers have a length of 2.0 m to 2.8 m, a cross-sectional width of 200 mm and a cross-sectional height of 4-10 mm.

There is also provided according to an embodiment of the invention a large scale field erected air cooled industrial steam condenser wherein the tubes in the primary condenser have a cross-sectional height of 5.2-7 mm.

There is also provided according to an embodiment of the invention a large scale field erected air cooled industrial steam condenser wherein the tubes in the primary condenser have a cross-sectional height of 5.9 mm.

There is also provided according to an embodiment of the invention a large scale field erected air cooled industrial steam condenser wherein the plurality of finned tubes in said primary condensers have fins attached to flat sides of said tubes, said fins having a height of 10 mm, and spaced at 9 to 12 fins per inch.

There is also provided according to an embodiment of the invention a large scale field erected air cooled industrial steam condenser wherein said plurality of finned tubes in said primary condensers have fins attached to flat sides of said tubes, said fins having a height of 18 mm to 20 mm spanning a space between adjacent tubes and contacting adjacent tubes, said fins spaced at 9 to 12 fins per inch.

There is also provided according to an embodiment of the invention a large scale field erected air cooled industrial steam condenser wherein a face area of all secondary condensers in a heat exchange bundle comprises 10-20% of a face area of all primary condensers in a same heat exchange bundle.

There is also provided according to an embodiment of the invention a large scale field erected air cooled industrial steam condenser wherein two primary condenser/secondary condenser pairs are adjacent to one-another with the secondary condensers of both pairs adjacent to one-another, said two secondary condensers combined into a single secondary condenser.

DETAILED DESCRIPTION

Figure 1A:
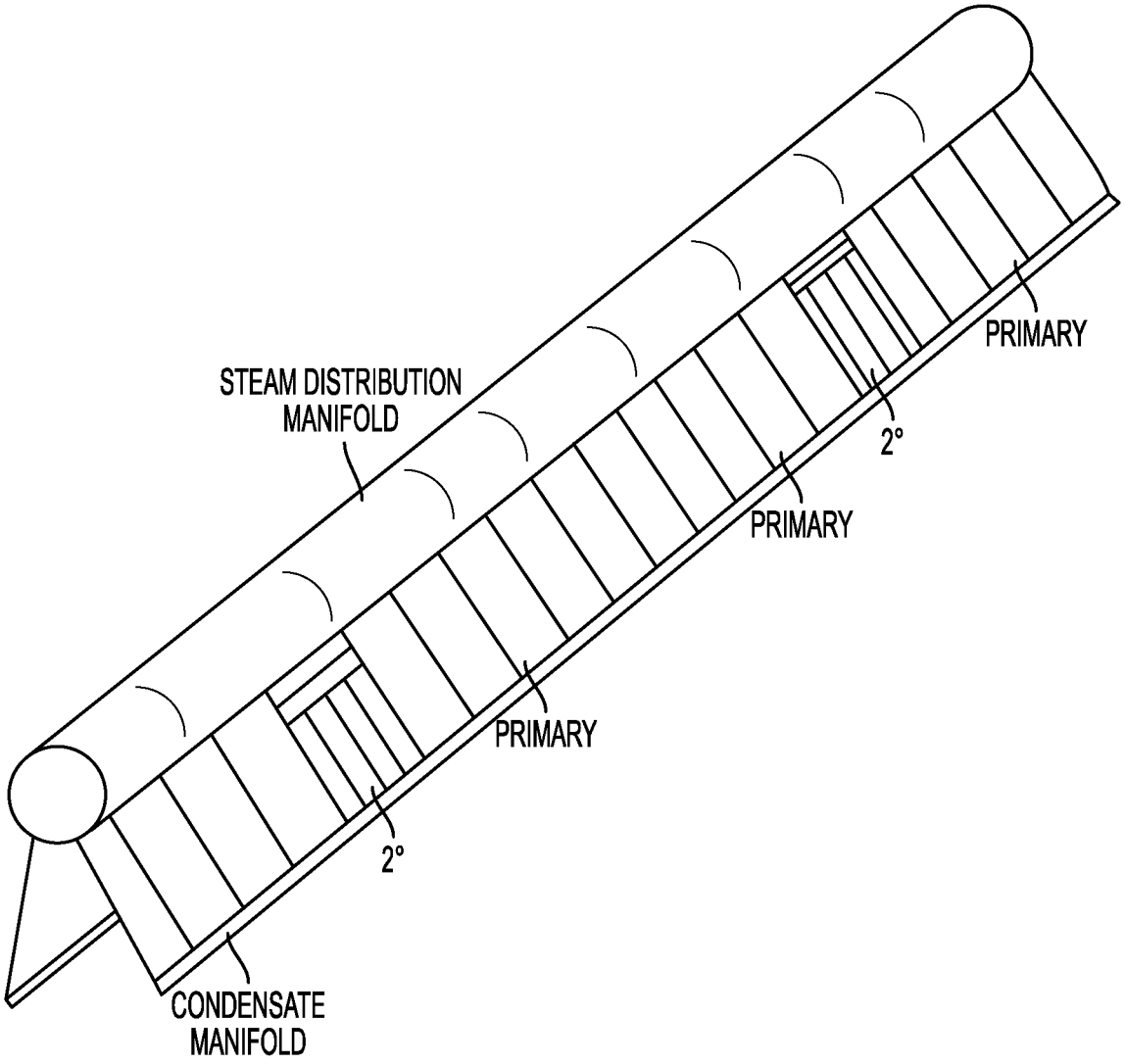
FIG. 1A PRIOR ART
FIG. 1A is a perspective view representation of the heat exchange portion of a prior art large scale field erected air cooled industrial steam condenser.
Figure 1B:
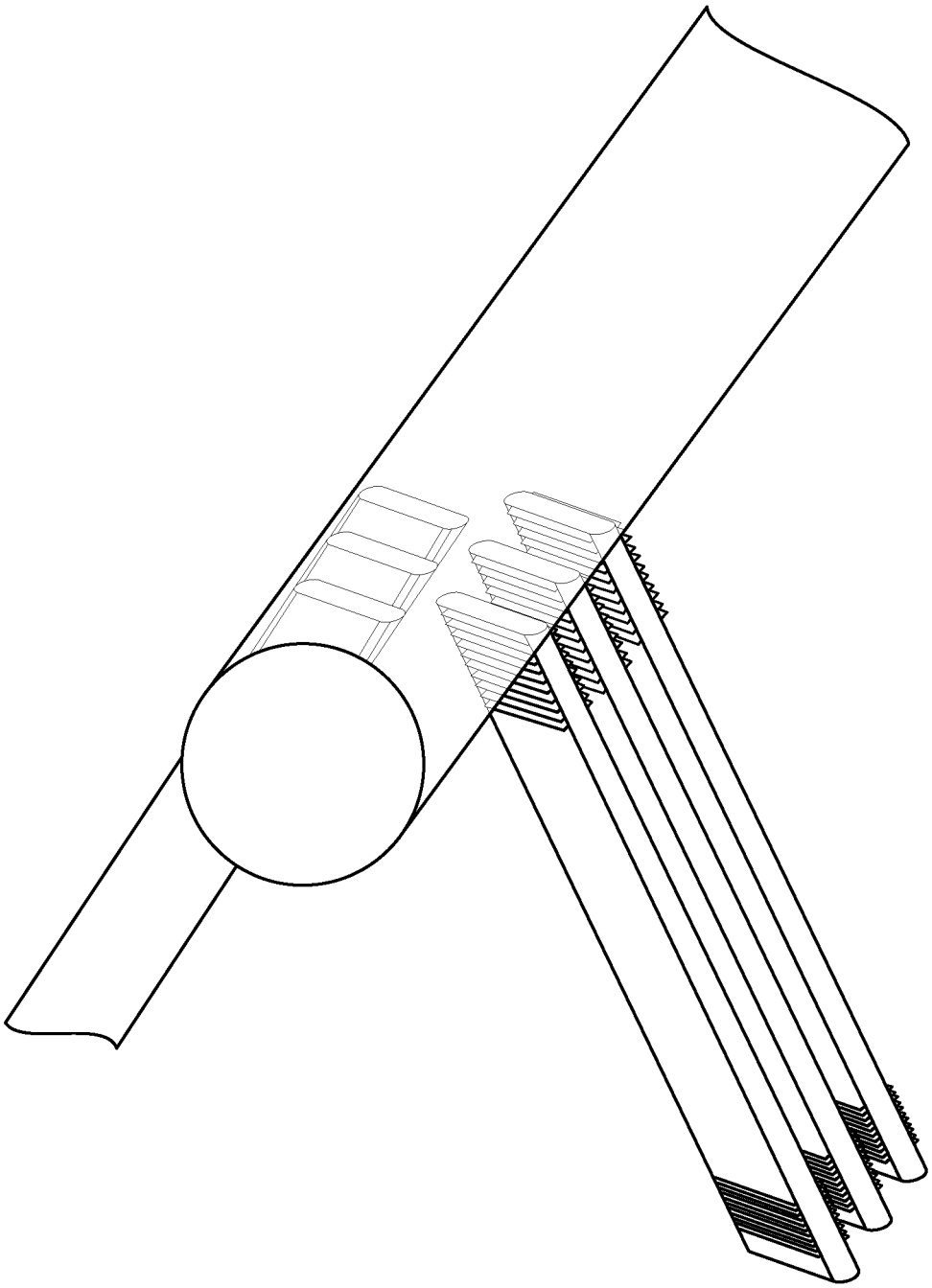
FIG. 1B PRIOR ART
FIG. 1B is a partially exploded close up view of the heat exchange portion of a prior art large scale field erected air cooled industrial steam condenser, showing the orientation of the tubes relative to the steam distribution manifold.
Figure 2A:
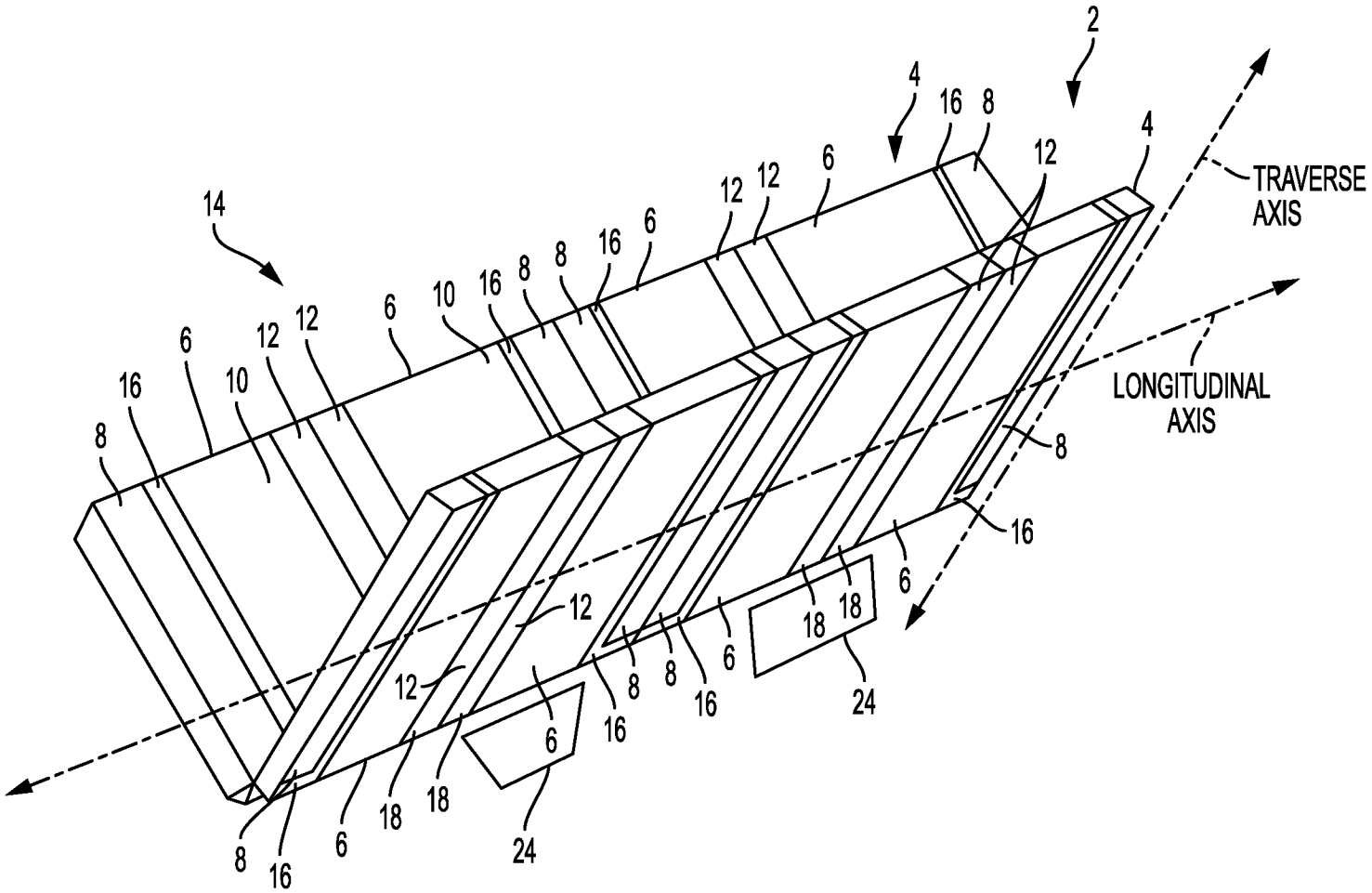
FIG. 2A a perspective view representation of the heat exchange portion of a large scale field erected air cooled industrial steam condenser ("ACC") according to a first embodiment of the invention.
Figure 2B:
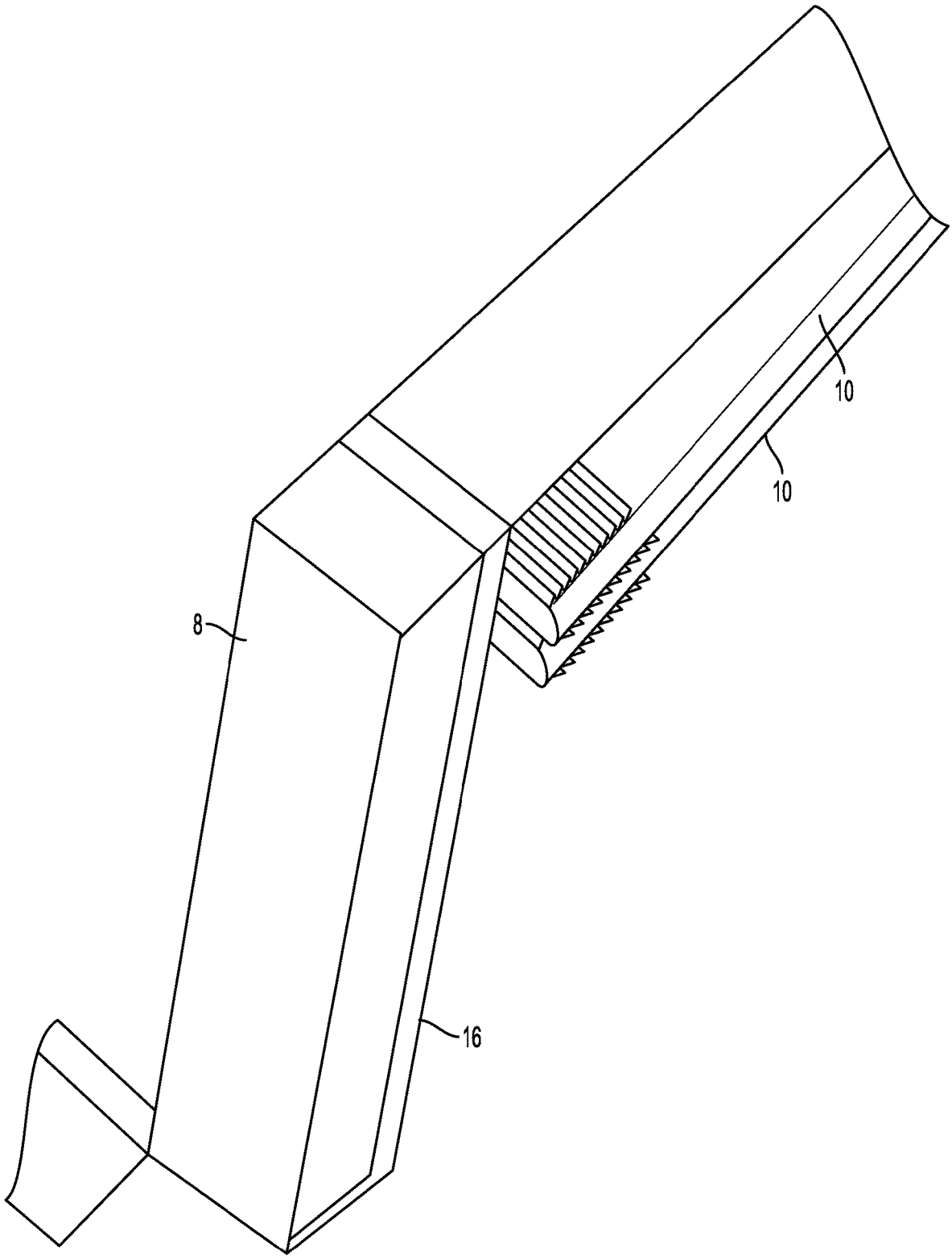
FIG. 2B is partially exposed close up view of the device shown in FIG. 2A, showing the orientation of the tubes in the primary condenser.
Figure 3:
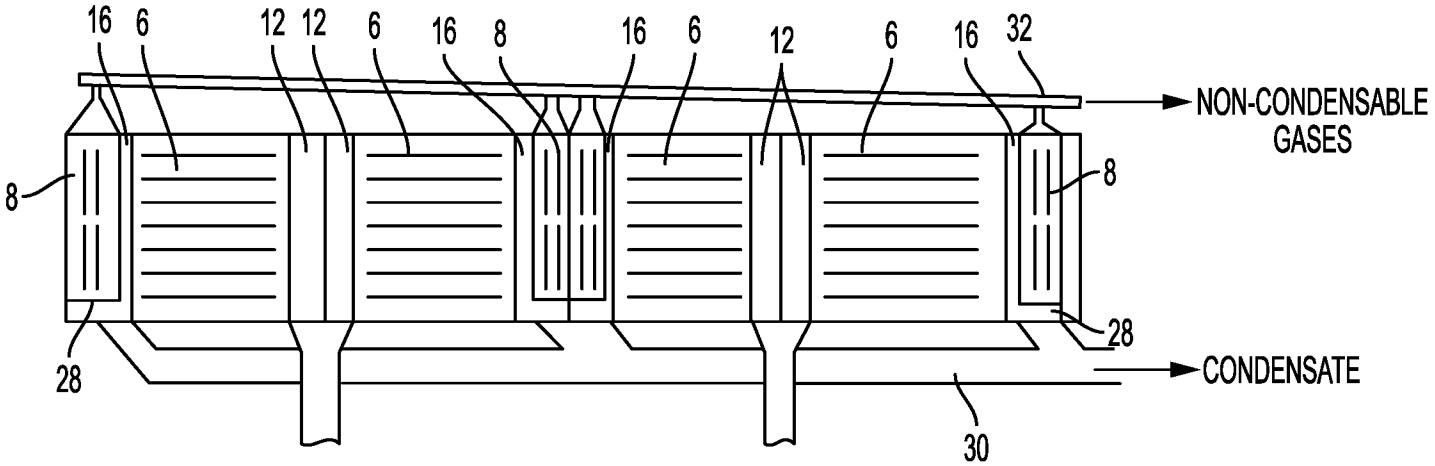
FIG. 3 a side view representation of the heat exchange portion of an ACC according to a preferred embodiment of the invention.

V-Shaped ACC with Horizontal Primary Condensers and Perpendicular Secondary Condensers Referring FIGS. 2A, 2B, and 3, bundle pair 2 may be constructed by joining two bundles 4 in a V configuration. Each bundle 4 is constructed of four primary condensers 6 and four secondary condensers 8, each secondary condenser 8 paired with a single primary condenser 6. Tubes 10 in the primary condensers 6 are arranged such that the tubes 10 are horizontal, while the inlet steam manifolds 12 at one end of the tubes are aligned parallel to the transverse axis of the bundle. This arrangement allows the steam to enter the small inlet steam manifolds 12 from below. The tubes 14 in the secondary condenser 8 are likewise aligned parallel to the transverse axis of the bundle. The preferred vertical height of each bundle is 91 inches (2.3 m) to 101 inches (2.57 m) and the preferred bundle length is 38 ft to 45 ft.

According to a preferred embodiment, measuring along the length of the bundle, each primary condenser 6 accounts for 2.6 m of the length; each steam manifold 12 and condensate outlet header 16 account for 0.3 m of the length, and each secondary bundle 8 accounts for 0.4 m of the length. In any event, each secondary bundle 8 accounts for 10% to 20% of the finned tube face area of the entire heat exchanger bundle.

Continuing to refer to FIGS. 2A and 3, the preferred heat exchanger bundle according to the invention consists, from one end to the other of the following: secondary condenser 8 with tubes 14 whose longitudinal axes are oriented parallel to the transverse axis of the bundle, followed by an outlet condensate header 16 (approx. 3 inches in size) adjacent to the secondary condenser 8 and communicating steam from a primary condenser 6 directly into the secondary condenser 8, followed by a full size primary condenser 6 with horizontal tubes 10. According to a preferred embodiment, each condensate header 16 has a foot 28 at its bottom that extends beneath and opens into its corresponding secondary condenser 8. The steam inlet manifold 12 (about 0.20 to 0.25 m per side) is at the far end of the first primary condenser 6. The second set of primary and second secondary condensers are mirrored from the first, completing the first half of the heat exchanger. The second half of the heat exchanger mirrors the first half. Adjacent secondary condensers as shown in FIG. 2A and at the center of FIG. 3 may be combined into a single secondary condenser. Condensate collected at the bottom of the condensate headers 16 flows into condensate collection tube 30. Non-condensable gases are drawn from the top of the secondary condensers 8 into non-condensable collection tube 32.

Figure 4:
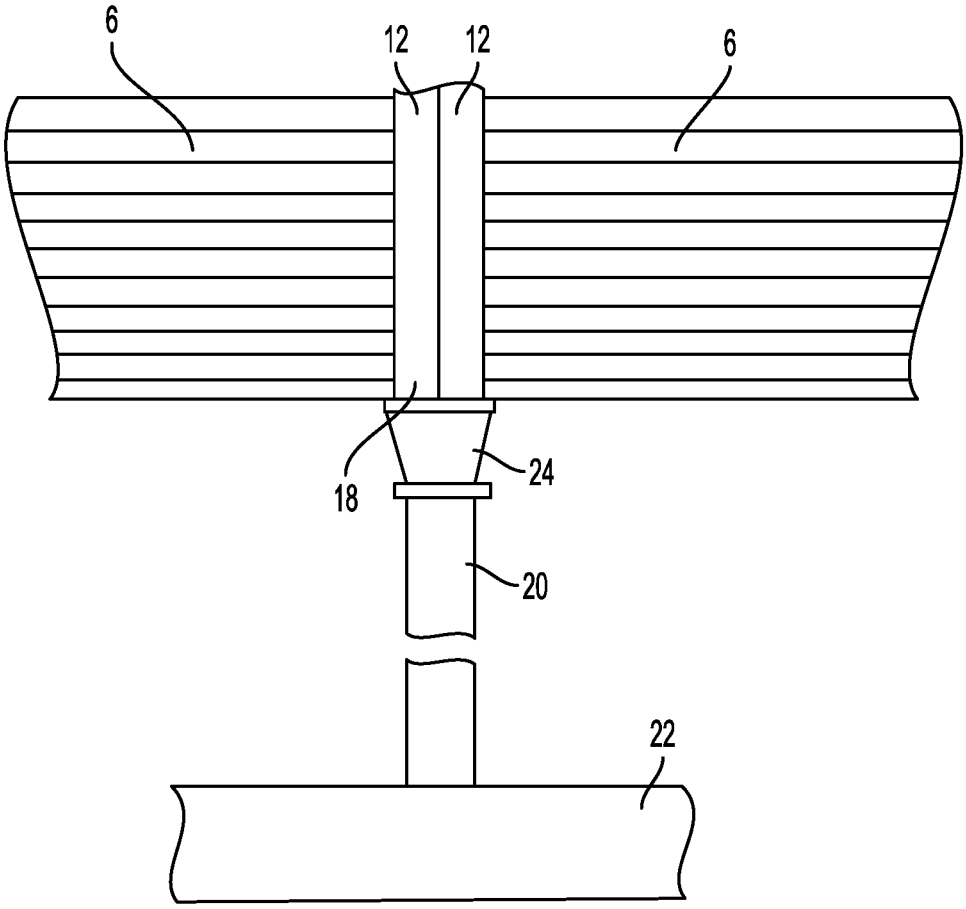
FIG. 4 is a close-up side view of the connection between a steam riser and corresponding steam headers at the bottom of the heat exchange portion of an ACC according to an embodiment of the invention.
Figure 5:
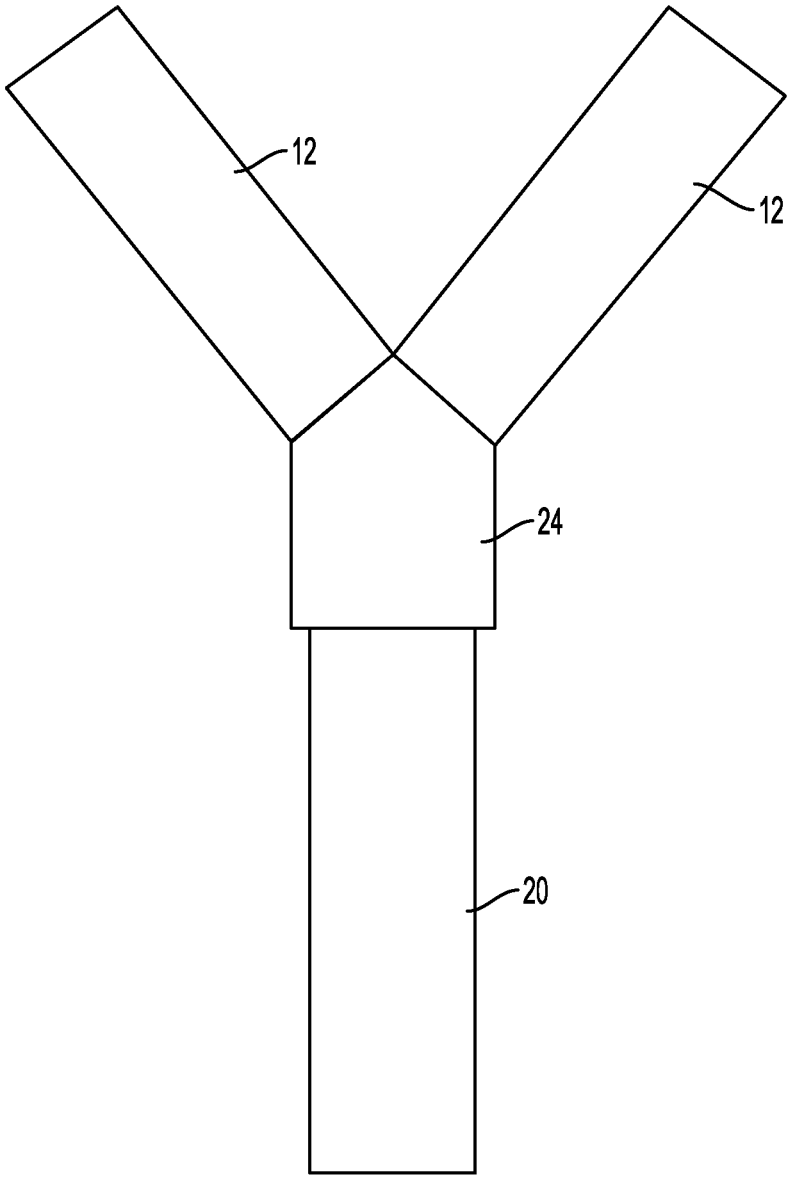
FIG. 5 is an end view of the steam riser/transition element/steam manifold assembly for an ACC according to an embodiment of the invention.

Bundles are then paired together, preferably in V-frames. This arrangement, as is shown in FIGS. 2A and 3, brings two sets of four steam inlets 18 to two single small areas. These four inlets can be joined to a single steam riser 20 emanating from a large steam duct 22, and connected together via a one to four adapter 24, see FIGS. 4 and 5. No welding of steam manifold across the length of the bundles is required. A-frames may be used, but are less cost effective.

Figure 8:
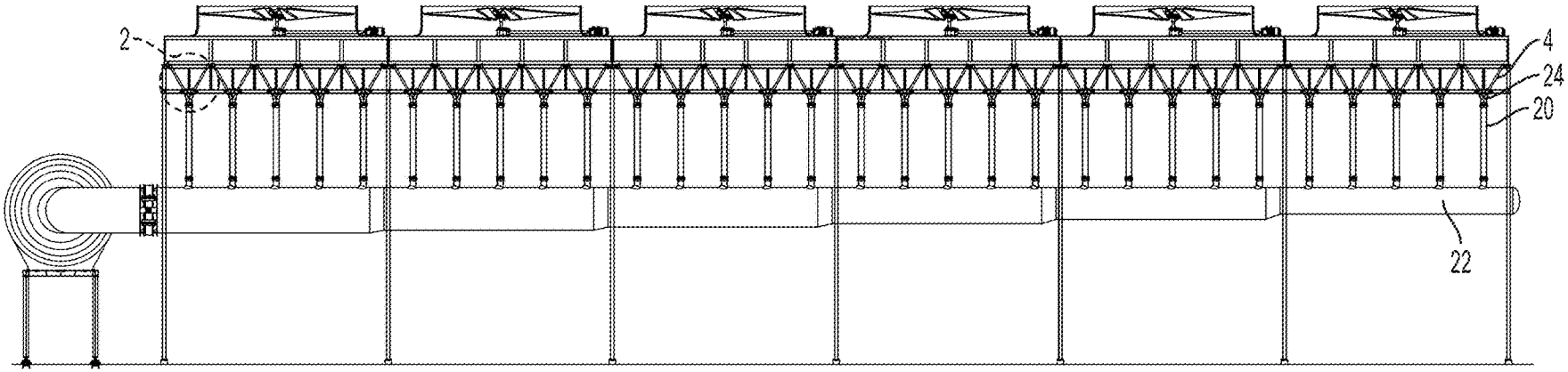
FIG. 8 is a side view of a large scale field erected air cooled industrial steam condenser according to an embodiment of the invention with V-shaped heat exchange bundle pairs having the primary and secondary condenser arrangement shown in FIG. 2A.
Figure 9:
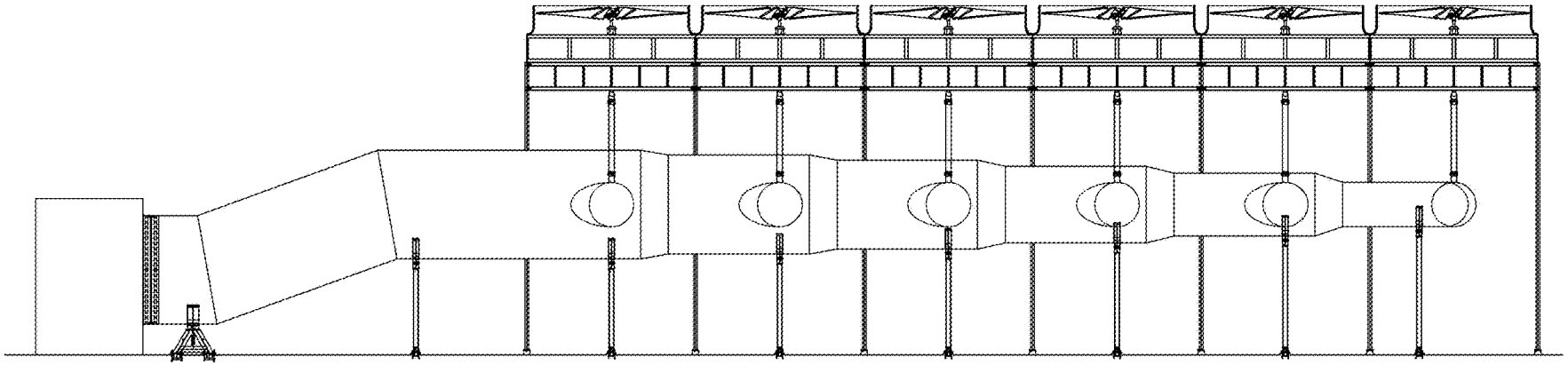
FIG. 9 is an end view of the large scale field erected air cooled industrial steam condenser shown in FIG. 8.
Figure 10:
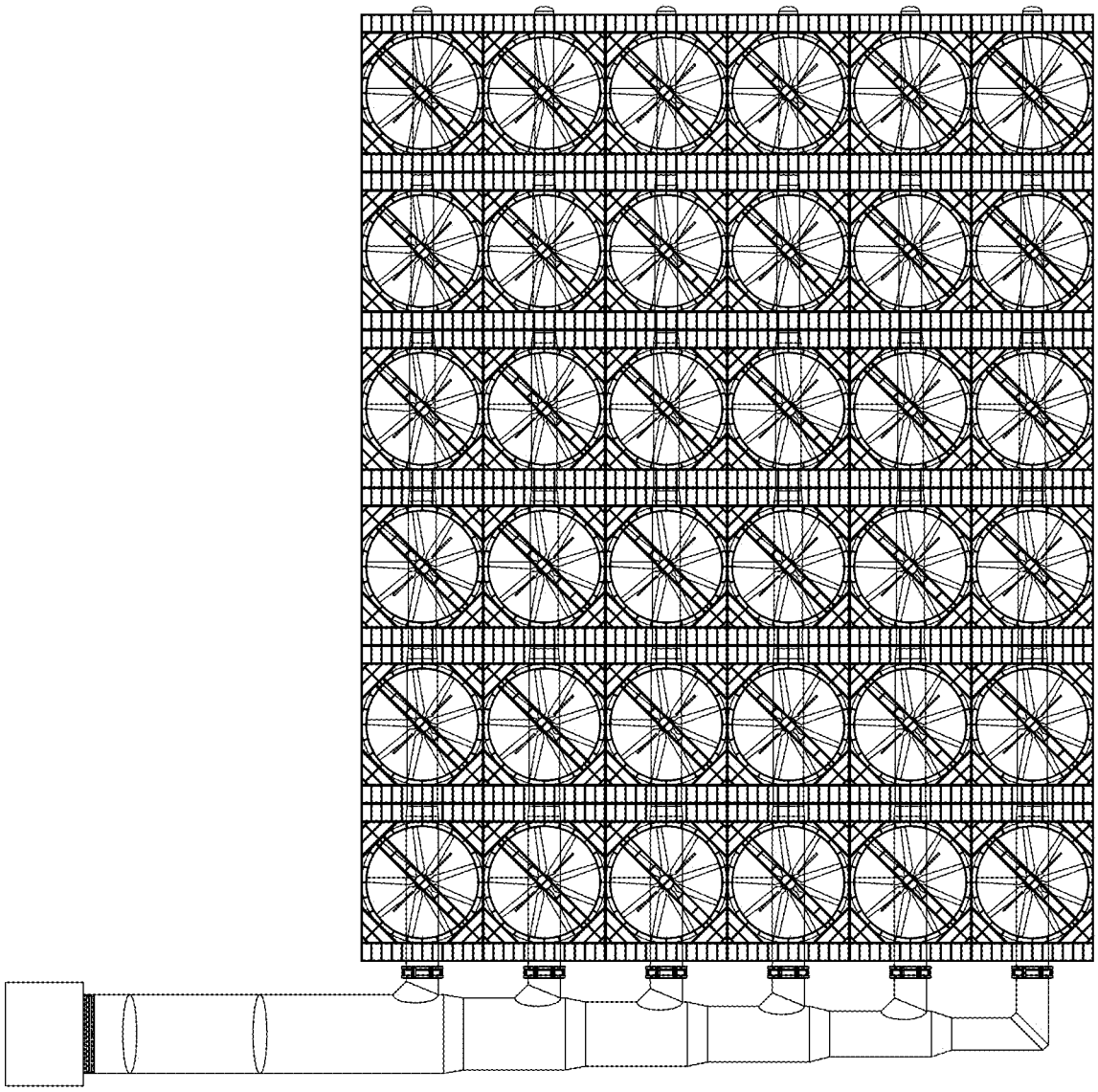
FIG. 10 is a top view the large scale field erected air cooled industrial steam condenser shown in FIG. 8.

FIGS. 8-10 show a representative large scale field erected air cooled industrial steam condenser according to an embodiment of the invention with V-shaped heat exchange bundle pairs having the primary and secondary condenser arrangement shown in FIG. 2A. The device shown in FIGS. 8-10 is a 36 cell (6 cell×6 cell) ACC, with the most preferred embodiment of five bundle pairs or "streets" per cell, but the invention may be used with any size ACC, and with any number of bundle pairs or streets per cell.

Compared to the designs disclosed in U.S. Published Patent Application No. US 2013/0312932, U.S. Published Patent Application No. 2015/0204611, and U.S. Published Patent Application No. 2015/0330709, the above-described embodiment of the present invention increases thermal capacity by 13%.

Figure 6:
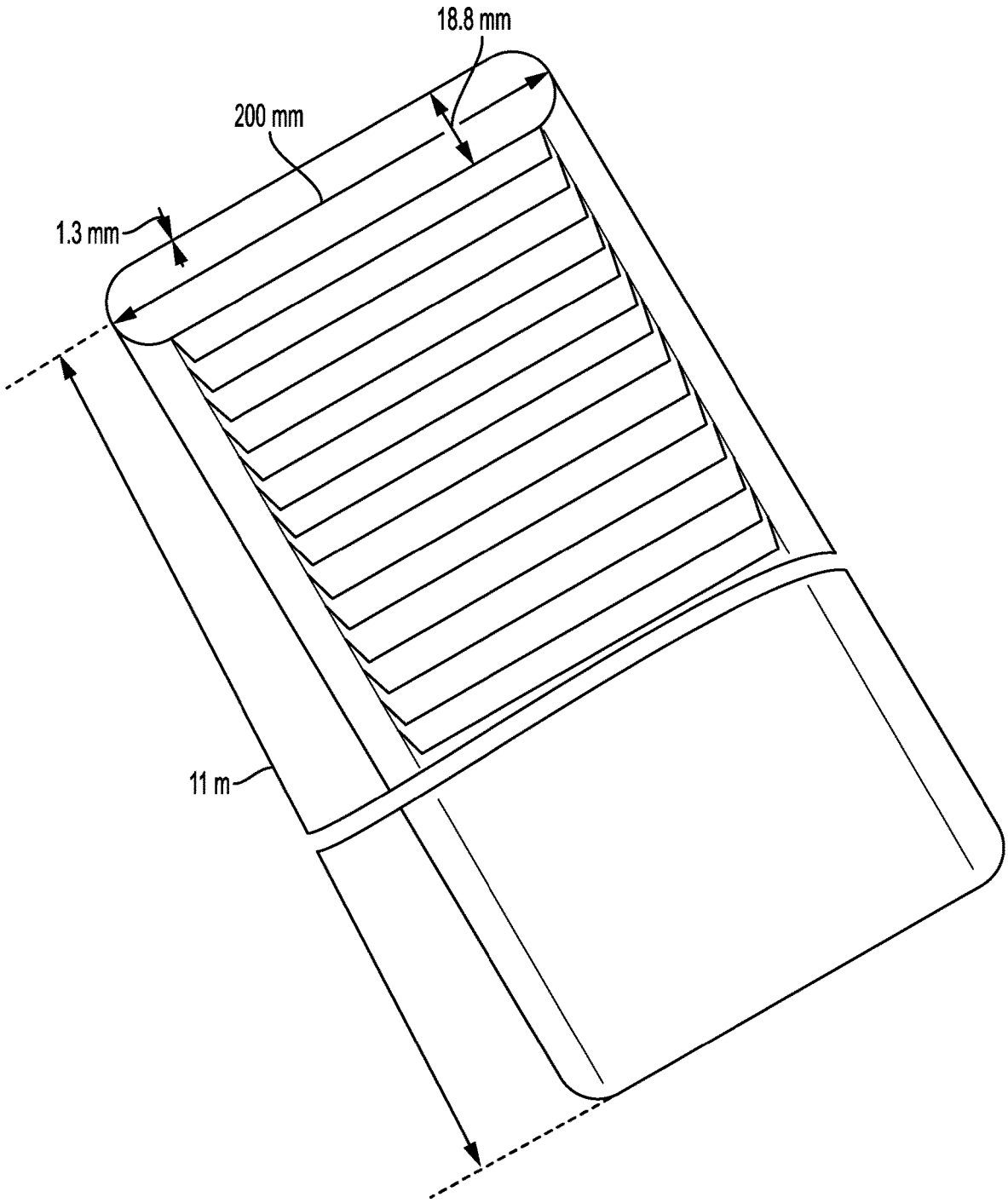
FIG. 6 PRIOR ART
FIG. 6 is a perspective view of cross-section of a prior art ACC tube and fins.

Compared to the current standard A-frame technology, the above-described embodiment of the present invention using primary tubes having standard cross-sectional shape and area (200 mm×18.7 mm), see, e.g., FIG. 6 (except for the tube length), increases thermal capacity by 5%, and substantially reduces installed cost by a similar degree.

Figure 7:
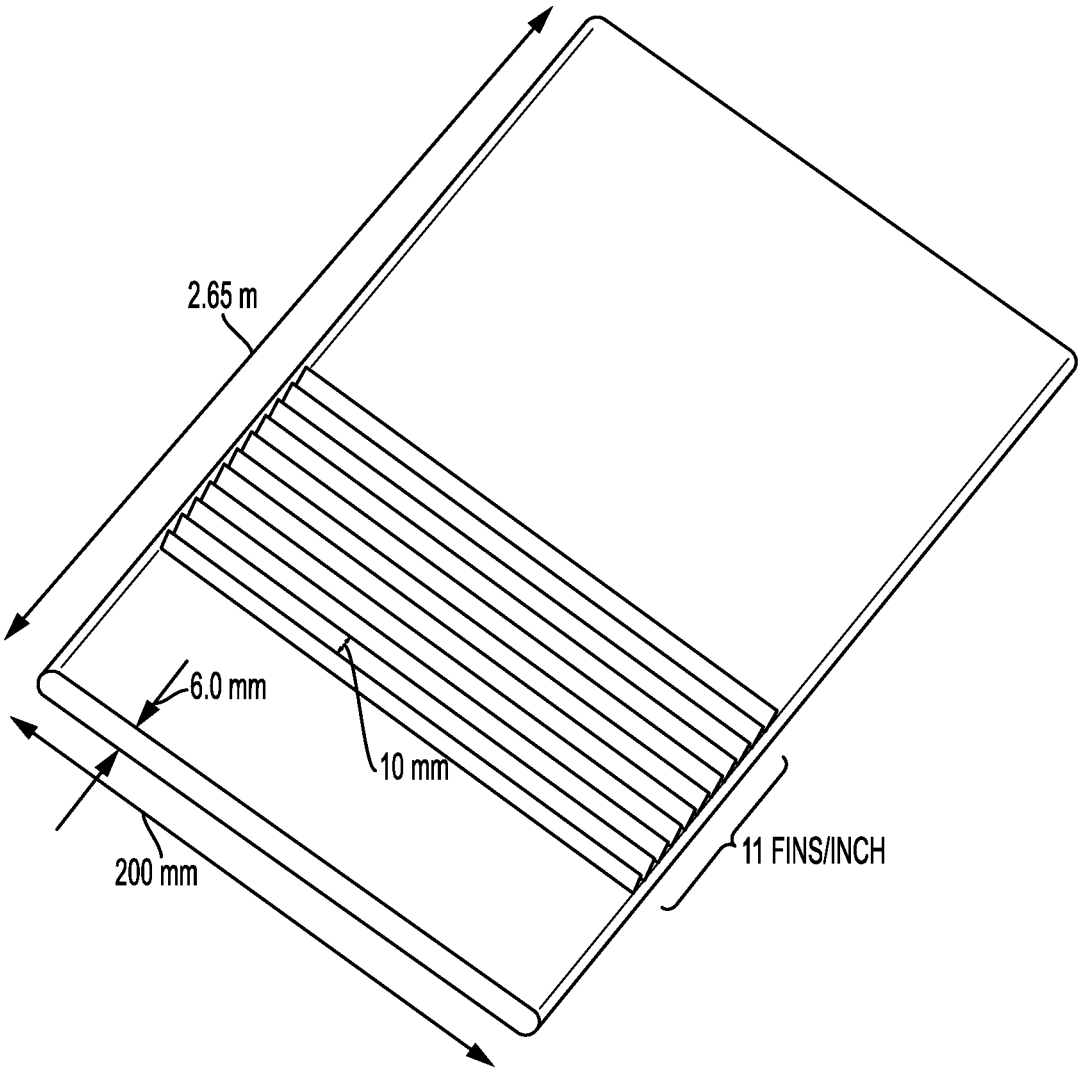
FIG. 7 is a perspective view of a first embodiment of a mini-tube and fins according to the present invention.
Figure 11:
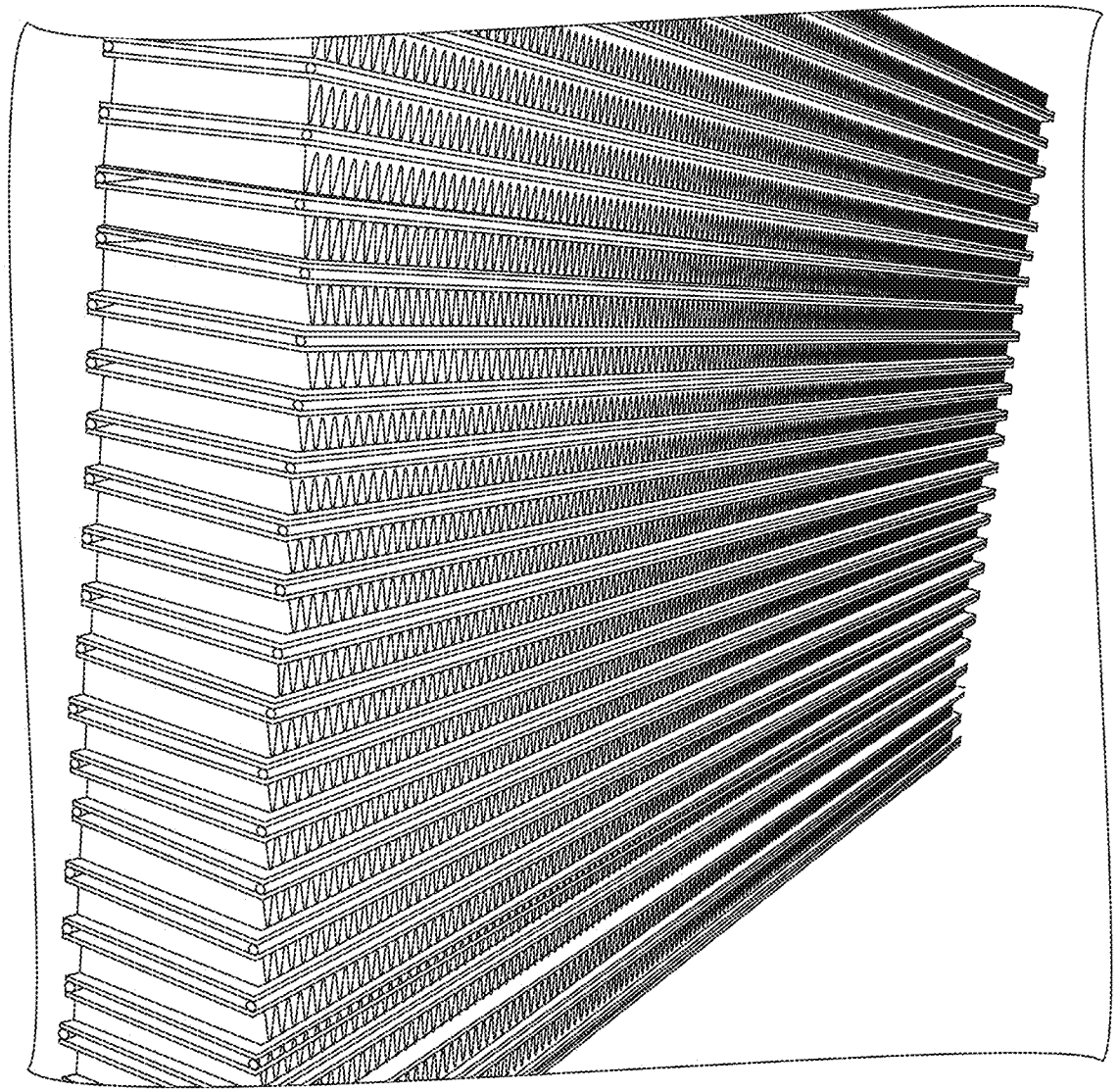
FIG. 11 is a perspective view drawing of a primary condenser finned tube bundle according to an embodiment of the invention.

According to a most preferred embodiment, the new ACC design described above may be used in conjunction with primary condenser tubes having cross-sectional dimensions of 200 mm wide (air travel length) with a cross-section height (perpendicular to the air travel length) of less than 10 mm, preferably 4-10 mm, more preferably 5.0-9 mm, even more preferably 5.2-7 mm, and most preferably 6.0 mm in height (with 0.8 mm tube thickness and 4.4 mm tube inner diameter), with fins that are 8-12 mm in height, preferably 10 mm in height, arranged at 8-12 fins per inch, preferably 11 fins per inch (FIG. 7). FIG. 11 shows a plurality of primary condenser tubes and fins assembled into a primary condenser bundle according to an embodiment of the invention. According to this preferred embodiment, an additional increase in capacity of 17% is provided, resulting in a combined increase over the prior art A-frame design with standard tubes of 30%, for a single cell at constant fan power.

According to a further preferred embodiment, actual fins may be 16-22 mm in height, preferably 18.5 mm in height, and span the space between two adjacent tubes, effectively making 8-11 mm of fin available to each tube on each side.

The description of fin type and dimension above is not intended to limit the invention. The tubes of the invention described herein may be used with fins of any type without departing from the scope of the invention.

The invention claimed is:

1. A large scale field erected air cooled industrial steam condenser connected to an industrial steam producing facility, comprising:

a plurality of pairs of heat exchanger bundles, each pair of heat exchanger bundles arranged in a V-shape or A-shape configuration, and each heat exchanger bundle having a longitudinal axis and a transverse axis perpendicular to its longitudinal axis, each heat exchanger bundle comprising at least one condenser section having a plurality of parallel finned tubes arranged in a row, each attached at a first end to a manifold arranged perpendicular to longitudinal axes of said finned tubes;

wherein said plurality of finned tubes have a length of about 2.0 m to about 2.8 m, a cross-sectional width of about 100 to about 200 mm and a cross-sectional height of less than about 10 mm.

2. A large scale field erected air cooled industrial steam condenser according to claim 1, wherein said plurality of finned tubes have a cross-sectional height of about 4-10 mm.

3. A large scale field erected air cooled industrial steam condenser according to claim 2, wherein said tubes have a cross-sectional height of about 5.2-7 mm.

4. A large scale field erected air cooled industrial steam condenser according to claim 3, wherein said tubes have a cross-sectional height of about 6.0 mm.

5. A large scale field erected air cooled industrial steam condenser according to claim 1, wherein said plurality of finned tubes have fins attached to flat sides of said tubes, said fins having a height of about 9 to about 10 mm, and spaced at about 6 to about 12 fins per inch.

6. A large scale field erected air cooled industrial steam condenser according to claim 1, wherein said plurality of finned tubes have fins attached to flat sides of said tubes, said fins having a height of about 18 mm to about 20 mm spanning a space between adjacent tubes and contacting adjacent tubes, said fins spaced at about 6 to about 12 fins per inch.

* * * * *